United States Patent [19]

Edwards et al.

[11] 4,150,333

[45] Apr. 17, 1979

[54] ELECTRONIC RECORDERS

[75] Inventors: Geoffrey S. Edwards, Grange over Sands; George A. Lapinski, Ulverston, both of England

[73] Assignee: Oxley Developments Company Limited, London, England

[21] Appl. No.: 752,182

[22] Filed: Dec. 17, 1976

[30] Foreign Application Priority Data

Dec. 19, 1975 [GB] United Kingdom ..... 52021/75

[51] Int. Cl.[2] ..... G04F 8/00

[52] U.S. Cl. ..... 324/186; 324/182

[58] Field of Search ..... 324/182, 186, 29.5, 324/181

[56] References Cited

U.S. PATENT DOCUMENTS

| | | | |
|---|---|---|---|
| 3,801,916 | 4/1974 | Brittain | 324/182 |
| 3,911,362 | 10/1975 | Roberts | 324/182 |
| 4,006,415 | 2/1977 | Finger | 324/182 |

*Primary Examiner*—M. Tokar

*Attorney, Agent, or Firm*—Scrivener, Parker, Scrivener and Clarke

[57] ABSTRACT

An electronic recorder is disclosed which acts as an elapsed time indicator for monitoring the operation of at least one item of equipment and providing display or other indication of the total time for which the item of equipment has been energized. The recorder includes a solid-state oscillator and a divider which together constitute a time-base for producing clock pulses only when the item of equipment is in an energized state. A solid-state counter counts the clock pulses and a solid-state memory stores information corresponding to the counter total. So that the recorder can retain its cumulative total count even when de-energized with the item of equipment, the memory is of the non-volatile type which retains its stored information even when de-energized. A solid-state display means displays the counter total to provide an indication of the total time for which the item of equipment has been energized.

To enable the recorder to be able to indicate not only for how long the equipment has been energized but also how many times it has been energized, means can be included for generating further clock pulses corresponding respectively to each energization of the item of equipment. A second solid-state counter counts the further pulses and a second solid-state memory of the non-volatile type stores information corresponding to the total of the second counter.

9 Claims, 3 Drawing Figures

ELECTRONIC RECORDERS

The present invention relates to electronic recorders and especially to such recorders adapted, inter alia, to act as elapsed time indicators.

An elapsed time indictor (ETI) is a device which monitors the operation of an item or items of equipment and records the cumulative total of the time periods for which the particular item of equipment, or several such items, is in operation.

Typically the equipment to be monitored is electrically operated and the ETI has simply been an electric clock which is switched on and off with the equipment. In this case, the clock provides the time base for the measurement of elapsed time (e.g. a 50 Hz. synchronous electric motor) and acts as a display and memory combined (i.e. the clock by the position of its fingers, not only displays the reading of elapsed time but also "remembers" its last reading when the clock is switched off).

Other types of known elapsed time indicators include electro-chemical devices. Here, the time base is the constant rate of an electrochemical reaction (e.g. the dissolution of an aluminium electrode by electrolysis) which can be switched on and off with the equipment, and the memory is the amount of chemical activity that has occurred (e.g. the amount of aluminium dissolved). The latter feature can also form the display.

Conventional ETI devices have several disadvantages, namely that they are relatively large, they usually consume excessive power and, being essentially mechanical devices with moving parts, their reliability is often unsatisfactory. Furthermore, devices based on electro-chemical phenomena are temperature sensitive and often present a contamination threat.

In accordance with the present invention, there is provided an electronic recorder for monitoring the operation of at least one item of equipment, comprising a solid-state oscillator and divider which together constitute a time-base for producing clock pulses only when said item of equipment is in an energised state, a solid-state counter for counting the clock pulses, a solid-state memory for storing information corresponding to the counter total, the memory being of the non-volatile type which retains its stored information even when de-energised, and a solid state display means for displaying the counter total to provide an indication of the total time for which said item of equipment has been energised.

Preferably, the counter is activated to perform a counting operation by the leading edge of each clock pulse and the output of the counter is presented both to the display means and to a gating circuit, the gating circuit being arranged to be controlled by the leading edge of each clock pulse such as to erase any information existing in the memory and to be further controlled by the trailing edge of that clock pulse such as to enable the information then existing in the counter to be written into the memory.

In order to enable the indicator to be reset to its previous reading following a period of de-energisation, the information in the memory is arranged to be constantly presented to a preset input of the counter, the preset input being arranged to be activated upon the indicator being re-energised following the period of de-energisation, whereby the counter, which lost its information during said period of de-energisation, is preset to contain the information from the memory, the latter information corresponding to the counter state immediately prior to such de-energisation.

In order to increase the counting capability of the indicator, the counter can conveniently comprise a plurality of series connected decade counter elements, each counter element being coupled to a corresponding display element by way of an associated de-coder.

The versatility of the aforegoing recorder can be extended by the provision of means for generating further clock pulses corresponding respectively to each energisation of said item of equipment being monitored, a second solid-state counter for counting said further clock pulses, and a second solid-state memory of the non-volatile type for storing information corresponding to the total of the second counter. This enables the recorder to monitor and indicate not only the total time the equipment has been in operation but also the total number of times the equipment has been turned on.

The invention is described further hereinafter, by way of example, with reference to the accompanying drawings, in which.

Figure 1:
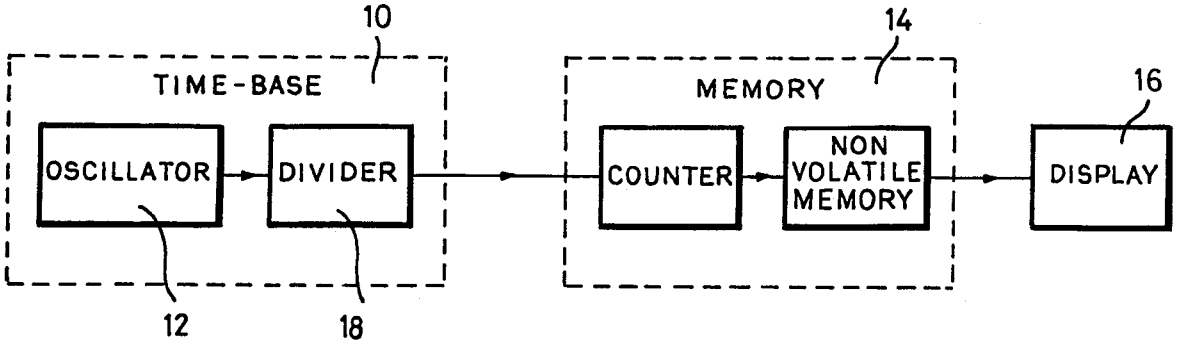
FIG. 1 is a schematic block diagram of one embodiment of an electronic recorder in accordance with the present invention adapted to indicate elapsed time.

The electronic recorder illustrated in FIG. 1 acts as an elapsed time indicator and comprises a solid-state time-base 10 which includes an oscillator 12, a solid-state memory 14 and a solid-state display 16. Because of size and stability requirements, the frequency of the oscillator 12 is such as to require division in a division 18 to enable generation of a sensible unit for the elapsed time. For example, an oscillator having a frequency of 4,660.43 Hz. can be divided by $2^{24}$ to give one pulse per hour. Another example would be a 32 kHz crystal oscillator which would require division by $2^{15}$ to give one pulse per second. Division of the frequency can be achieved using conventional IC logic in the divider 18. One pulse per hour is the typical unit of time required for an application in radio communication equipment with a maximum period of elapsed time to be recorded of 9999 hours, although of course other units and maximum periods can be selected to suit other applications. The readout can be performed by 4 seven-segment light emitting diode (LED) numerics, although other devices such as liquid crystal displays can alternatively be used.

Figure 2:
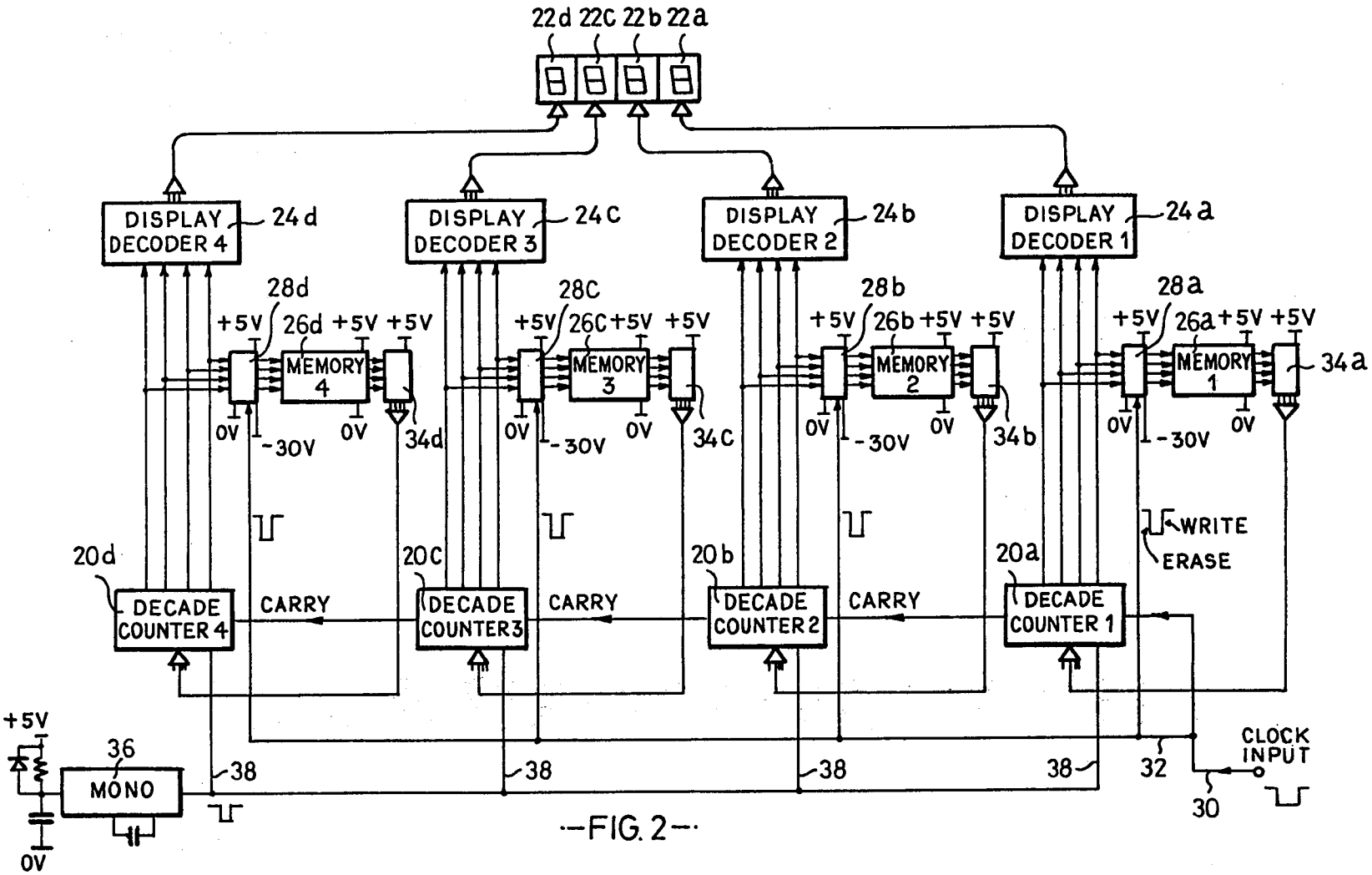
FIG. 2 is a schematic circuit diagram of one embodiment of the memory and display units for the recorder of FIG. 1.

FIG. 2 illustrates one example of a memory 14 and display 16 circuit for the system of FIG. 1. The object and function of this part of the system is to count and store pulses from the time-base (clock pulses) such that when the circuit is switched off the memory retains the information ready for updating by the first of the pulses produced by the time-base when the circuit is next switched on.

The circuit of FIG. 2 includes four decade counters 20*a*, 20*b*, 20*c*, 20*d* each of which is associated with a respective numeric display device 22 (*a* to *d*) and a corresponding de-coder 24 (*a* to *d*). Associated with each of the four decade counters 20 is a respective memory device 26 (*a* to *d*) connected to that counter 20 via a gating and mode control logic 28 (*a* to *d*). The memory devices 26 must be of the so-called "non-volatile" type, this being a solid-state device which retains the information stored therein without significant deterioration even when de-energised. An example of a non-volatile memory is the metal-nitride-oxide-silicon (MNOS) type.

The first input clock pulse from the divider enters the first decade counter 20*a* via an input line 30 and generates the binary code (BCD) for 1 (one hour having elapsed). On the next clock pulse, a BCD for 2 is generated and so on to 9. Subsequent clock pulses then carry over to the next decade counter 20*b* to generate the BCD for the next figure in the "tens" display 22*b* and so on to 9999 in a conventional manner, the count occurring on the leading edge of the clock pulses. The BCD outputs from the decade counters 20 drive the appropriate numeric displays 22 via the corresponding de-coders 24. By way of example, the displays 22 can be of the seven-segment LED type.

Simultaneously to entering the display decoders 24, the BCD outputs from the decade counters 20 enter the associated gating and mode control IC logic units 28. The clock pulses are also presented to each of these units 28 via a line 32 leading to the line 30. Each leading edge of a clock pulse is arranged to erase any information carried in the memory devices 26. The trailing edge of each clock pulse is however arranged to activate all of the units 28 to enable the BCD information from the decade counters 20 to be written into the associated memory devices 26.

Each memory device 26 is conveniently an MNOS 16×1 array, or four 4×1 arrays. By virtue of the aforegoing mode of operation, information is continously being erased and written into the non-volatile memory devices 26 when the leading edge and trailing edge of each clock pulse enter the units 28. Although erased from the memory devices 26, the information is of course not lost because the decade counters 20 retain the information whilst the electrical circuit is energised. However, when the circuit is switched off, the memory devices 26 automatically have the latest information stored in them. When the circuit is switched on again, this information in the memory devices is used to prime the counters 20 to resume the count where they last left off.

This is achieved by arranging for the information written into the memory devices to be simultaneously presented via respective level translators 34 (*a* to *d*) to PRESET INPUTS of the associated counters 20. When the electrical supply to the circuit is switched off, the information is lost from the decade counters 20. However, corresponding information is retained in the non-volatile memory devices 26 and, when the circuit is re-energised, the last information supplied to the memory is automatically presented to the PRESET INPUTS of all of the counters 20. A monostable multivibrator 36 is provided which, after a short delay of the order of a few milliseconds, produces a pulse which is transferred to the LOAD inputs of the counters 20 via lines 38 to activate the latter inputs and cause the transfer of the information on the PRESET INPUTS to the outputs of the counters 20. The numeric outputs thus display the information recorded in the memory units 26 immediately prior to the last de-energisation of the circuit so that the decade counters 20 are re-activated with this information to resume the counting of clock pulses where they last left off.

The aforegoing sequence of manoeuvres occurs each time the system is switched on and off so that the total number of hours that the equipment has been in operation is therefore recorded.

The solid state circuitry for the oscillator 12, divider 18, counters 20, non-volatile memories 26 and possibly also the display drivers, can all be integrated onto one semi-conductor chip packaged, for example, in a 16 pin dual-in-line module. In another arrangement, the oscillator 12 and divider 18 can be on one chip with the counters 20 and the memory on another chip, i.e. two dual-in-line packages with suitable integration dependent on the design considerations of the equipment with which the ETI is to operate.

In comparison with the initially described known elapsed time indicators, the presently proposed solid state device has the advantages that it can be very small, is inherently more reliable than a mechanical device and consumes much less power than a conventional electro-mechanical system.

Furthermore, as electrical equipment becomes more sophisticated, there is an increasing need for recording how long particular sub-units in the main equipment have been in use. Here, another advantage of a solid-state ETI is that the oscillator, the memory and the display can be physically separate from each other. The only element which need be associated with a particular sub-unit is the memory so that the oscillator could be common, feeding several memories; so also could the display which could be selected as required to display the content of particular memories or other parameters relevant to a particular equipment (e.g. the frequency band in a communications set).

Yet another advantage of a solid-state ETI is that the memory can be used to record information other than elapsed time, which is useful for the service and reliability engineer, for example, to indicate how many times a unit has been switched on, what is the average length of time it has been on, and the like.

Figure 3:
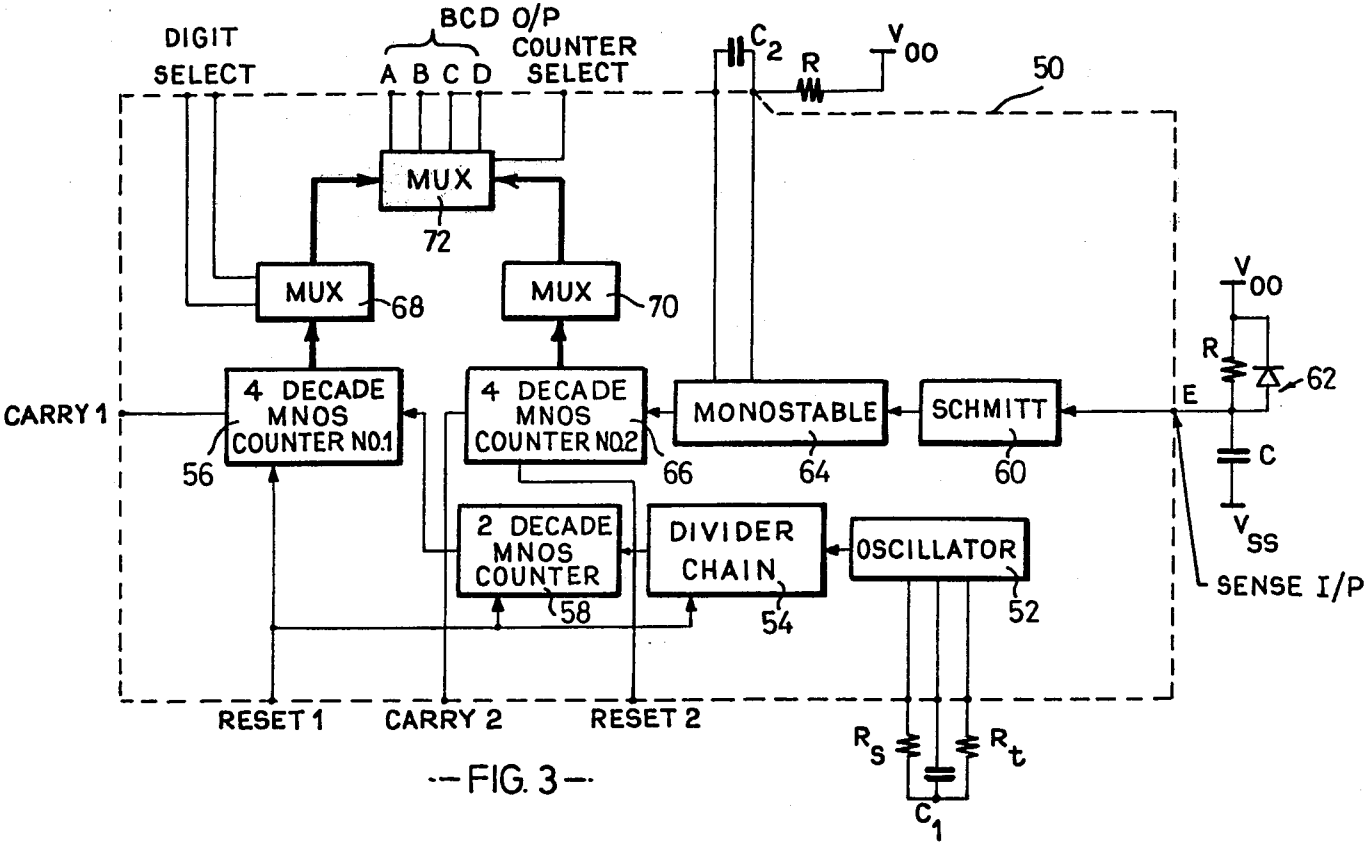
FIG. 3 is a schematic block diagram of a second embodiment of an electronic recorder in accordance with the present invention adapted to indicate both elapsed time and the total number of times an associated apparatus has been actuated.

An embodiment is illustrated in FIG. 3 which can record and indicate not only the total time for which the associated equipment is in operation (ETI) but also the number of times the equipment is turned on during its operating lifetime. This embodiment includes an integrated circuit or printed circuit 50 adapted to be mounted within a piece of equipment to be monitored. The associated display device corresponding to the display decoders 24 and numeric displays 22 of FIG. 2 is not shown but would normally be located at a convenient display location separated from the equipment and connected to the circuit 50 by way of terminals A to D.

A main oscillator 52, corresponding to the oscillator 12 of FIG. 1, feeds a high frequency signal to a divider chain 54 whenever the equipment is actuated, the divider chain 54 supplying clock pulses to a 4 decade MNOS counter 56 via a 2 decade MNOS counter 58. The purpose of the latter counter 58 is to increase the resolution of the device whereby actuation of the equipment for periods less than the interval between main clock pulses is recorded. The circuitry included in the block 56 corresponds substantially to a combination of the blocks 20, 26, 28 and 34 of FIG. 2 whereby to provide a BCD output corresponding to the total time for which the equipment has been in operation.

Schmitt trigger 60 is included which is arranged to be connected via a terminal E to an external circuit 62 which produces an input signal to the Schmitt trigger 60 whenever the power supply Vss is applied to the equipment, i.e. whenever the equipment is turned on. Actuation of the Schmitt trigger 60 fires a monostable 64 which provides a clock pulse for a second 4 decade MNOS counter 66. The latter counter 66 also corresponds substantially to the arrangement of blocks 20, 26, 28 and 34 in FIG. 2 whereby to provide a BCD output corresponding to the total number of clock pulses formed, i.e. to the total number of times the equipment has been switched on.

The BCD outputs of the counters 56 and 66 are supplied via individual multiplexing elements 68 and 70 to a main multiplexing unit 72 which provides one or other of the BCD outputs to the externally connected display unit or alternatively provides the BCD outputs cyclically one after the other. A DIGIT SELECT input enables the unit 72 to provide the BCD output corresponding to the elapsed time and a COUNTER SELECT input enables the unit 72 to provide the BCD output corresponding to the total number of times the equipment has been switched on.

Externally connected resistors Rs, Rt and a capacitor $C_1$ are provided for adjusting or trimming the operating frequency of the oscillator 52 and an externally connected capacitor $C_2$ is provided for trimming the monostable 64. CARRY 1 and CARRY 2 terminals are provided for connection to additional counters if the reading capability of the device is to be extended. RESET 1 and RESET 2 terminals enable the counters 56, 58 and at least part of the divider chain 54 to be cleared when operation of the device is to be initiated.

In an alternative embodiment, separate BCD outputs and displays could be used for the counters 56, 66, which would obviate the necessity for the multiplexing elements 68, 70 and 72.

We claim:

1. An electronic recorder for monitoring the operation of at least one item of equipment, comprising a solid state oscillator, a divider coupled to the output of the oscillator, the oscillator and divider together constituting a time base for producing clock pulses only when said item of equipment is in an energised state, a solid state counter adapted to count the clock pulses from said time base, a display means coupled to the counter for displaying the counter total to provide an indication of the total time for which said item of equipment has been energised, gating means coupled to the output of the counter, a solid state memory coupled to said counter via said gating means for storing information corresponding to the counter total, the memory being of the non-volatile type which retains its stored information even when de-energised, signal level translator means for coupling signal levels carried by the memory to preset input means on the counter, the arrangement being such that the updated counter total is always carried by the memory even when the recorder is de-energised with said item of equipment so that upon re-energisation, the signal level presented by the level translator means at said preset input means of the counter can reset the counter to the value it had reached immediately prior to the last de-energisation of said recorder and item of equipment, the preset input means being activated upon the recorder being re-energised following the period of de-energisation, and means responsive to the receipt of each said clock pulse to erase any information existing in said memory and thereafter to enable information then existing in the counter to be written into said memory.

2. An electronic recorder according to claim 1 in which the counter is activated to perform a counting operation by the leading edge of each clock pulse, and in which said gating means is controlled by the leading edge of each clock pulse such as to erase any information existing in the memory and is further controlled by the trailing edge of that clock pulse such as to enable the information then existing in the counter to be written into the memory.

3. An electronic recorder according to claim 1 in which, in order to increase the counting capability of the indicator, the counter comprises a plurality of series connected decade counter elements and a plurality of decoders, each counter element being coupled to a corresponding display element by way of an associated one of said decoders.

4. An electronic recorder for monitoring the operation of at least one item of equipment, comprising a solid state oscillator, a divider coupled to the output of the oscillator, the oscillator and divider together constituting a time base for producing clock pulses only when said item of equipment is in an energised state, a solid state counter adapted to count the clock pulses from said time base, a display means coupled to the counter for displaying the counter total to provide an indication of the total time for which said item of equipment has been energised, gating means coupled to the output of the counter, a solid state memory coupled to said counter via said gating means for storing information corresponding to the counter total, the memory being of the non-volatile type which retains its stored information even when de-energised, signal level translator means for coupling signal levels carried by the memory to preset input means on the counter, the arrangement being such that the updated counter total is always carried by the memory even when the recorder is de-energised with said item of equipment so that upon re-energisation, the signal level presented by the level translator means at said preset input means of the counter can reset the counter to the value it had reached immediately prior to the last de-energisation of said recorder and item of equipment, and means for generating further clock pulses corresponding respectively to each energisation of said item of equipment being monitored, a second solid-state counter coupled to said further clock pulse generating means for counting said further clock pulses, and a second solid-state memory of the non-volatile type coupled to said second counter for storing information corresponding to the total of the second counter.

5. An electronic recorder according to claim 4 further including a second display means coupled to said second counter for displaying the total count of the second counter.

6. An electronic recorder according to claim 4, including a multiplexing circuit for alternately connecting the total counts of the first and second counters to the display means.

7. An electronic recorder as claimed in claim 4 in which said means for generating the further clock pulses comprises a monostable multivibrator triggered by a Schmitt trigger to which an input signal is arranged to be supplied whenever said item of equipment is switched on.

8. An electronic recorder for monitoring the operation of at least one item of equipment, comprising a solid-state oscillator and divider which together constitute a time-base for producing clock pulses only when said item of equipment is in an energised state, a solid-state counter adapted to count the clock pulses from said time-base, gating means, a solid-state memory coupled to the counter by said gating means for storing information corresponding to the counter total, the memory being of the non-volatile type which retains its stored information even when de-energised, and a display means coupled to the counter for displaying the counter total to provide an indication of the total time for which said item of equipment has been energised, the counter being arranged to be activated to perform a counting operation by the leading edge of each clock pulse and the output of the counter being presented both to the display means and to said gating means, the gating means being controlled by the leading edge of each clock pulse such as to erase any information existing in the memory and being further controlled by the trailing edge of that clock pulse such as to enable the information then existing in the counter to be written into the memory.

9. An electronic recorder for monitoring the operation of at least one item of equipment, comprising a solid state oscillator; a divider coupled to the output of the oscillator, the oscillator and divider together constituting a time base for producing clock pulses only when said item of equipment is in an energised state; a solid state counter adapted to count the clock pulses from said time base and including a plurality of series connected decate counter lements and a plurality of decoders; a display means coupled to the counter for displaying the counter total to provide an indication of the total time for which said item of equipment has been energised; gating means coupled to the output of the counter; a solid state memory coupled to said counter via said gating means for storing information corresponding to the counter total, the memory being of the non-volatile type which retains its stored information even when de-energised; signal level translator means for coupling signal levels carried by the memory to preset input means on the counter, the arrangement being such that the counter total is carried by the memory when the recorder is de-energised with said item of equipment so that upon re-energisation, the signal level presented by the level translator means at said preset input means of the counter can reset the counter to the value it had reached immediately prior to the last de-energisation of said recorder and item of equipment, said preset input means being activated upon the recorder being re-energised following the period of de-energisation, and means for erasing any information existing in said memory after said preset input means is activated and said counter reset upon re-energisation of said recorder.

* * * * *